US009497533B2

(12) United States Patent
Wu et al.

(10) Patent No.: US 9,497,533 B2
(45) Date of Patent: Nov. 15, 2016

(54) FINE TUNING STRUCTURE FOR HEADPHONES AND HEADPHONE

(71) Applicant: Shenzhen Grandsun Electronic Co., Ltd., Shenzhen, Guangdong (CN)

(72) Inventors: Haiquan Wu, Guangdong (CN); Ruiwen Shi, Guangdong (CN); Jiugao Peng, Guangdong (CN); Xin Yu, Guangdong (CN)

(73) Assignee: SHENZHEN GRANDSUN ELECTRONIC CO., LTD., Shenzhen (CN)

( * ) Notice: Subject to any disclaimer, the term of this patent is extended or adjusted under 35 U.S.C. 154(b) by 25 days.

(21) Appl. No.: 14/622,991

(22) Filed: Feb. 16, 2015

(65) Prior Publication Data

US 2015/0382092 A1 Dec. 31, 2015

Related U.S. Application Data

(63) Continuation-in-part of application No. PCT/CN2014/081231, filed on Jun. 30, 2014.

(51) Int. Cl.
*H04R 1/10* (2006.01)
*H04R 5/033* (2006.01)

(52) U.S. Cl.
CPC ..... *H04R 1/1066* (2013.01); *H04R 1/10* (2013.01); *H04R 5/0335* (2013.01)

(58) Field of Classification Search
CPC H04R 1/1066; H04R 1/0335; H04R 5/0335; H04R 1/10
USPC ..... 381/74, 72, 182, 370, 374, 376, 381/378–379, 386
See application file for complete search history.

(56) References Cited

U.S. PATENT DOCUMENTS 6,629,579 B1 * 10/2003 Hasegawa ..... H04R 1/1066 181/129
2011/0116674 A1 * 5/2011 Asakura ..... H04R 1/1066 381/378

* cited by examiner

*Primary Examiner* — Disler Paul
(74) *Attorney, Agent, or Firm* — Rankin, Hill & Clark LLP

(57) ABSTRACT

The present invention relates to the field of headphone technology and provides a fine tuning structure for headphones, configured for tuning an angle between a head band and an audible unit of the headphone, the fine tuning structure includes an upper assembly connected to an end of the head band and a lower assembly connected to the audible unit, the upper assembly and the lower assembly are hinged together, the upper assembly is provided with a limiting step, the lower assembly is movably connected to a limiting part, an end face of the limiting part is provided with a limiting curved surface abutted against the limiting step and configured for limiting an angle of the lower assembly relative to the upper assembly. In the fine tuning structure according to the present invention, the angle between the upper assembly and the lower assembly can be tuned via selecting a different place of the limiting curved surface to abut against the limiting step, so that the angle of the audible unit relative to the head band can be tuned, and the wearing comfort of the headphone can be improved.

10 Claims, 3 Drawing Sheets

FINE TUNING STRUCTURE FOR HEADPHONES AND HEADPHONE

BACKGROUND OF THE INVENTION

1. Technical Field

The present invention relates to the field of headphone technology, and more particularly, to a fine tuning structure for headphones and a headphone.

2. Description of Related Art

Headphones and ear buds are common audio devices. Compared with the ear bud, the headphone has a larger size and includes two larger audible units, and the two larger audible units are connected together via an elastic head band. When the headphone is used, the audible units are pressed to closely contact with human ears. Since the headphone with an integrative structure has bad adaptability to human heads with different shapes and human ears at different positions, it is necessary to improve the adaptability via a tuning structure able to tune the position of the audible unit.

In prior art, the headphone can be tuned via tuning the length of the head band or the length of connecting parts between the head band and audible units. The tuning of the length of the head band can apply to the human heads with different shapes, the tuning of the length of connecting parts can apply to the human ears at different positions, however, both of the tuning manners can't tune the angle of the audible unit, the wearing adaptability of the headphone is affected. Furthermore, the headphone adopts a surrounding manner to make a sound, that is the audible units adopt enclosed spaces formed by surrounding auricles using soft objects, such as sponges, to transmit sound. Therefore, if the angle of the audible unit doesn't match with the auricle, the space will not be completely enclosed, which will cause sound to leak.

The tuning structure can't meet user's requirements in the prior art, especially, in the high-end headphone field with higher sound quality and comfortableness requirements.

BRIEF SUMMARY OF THE INVENTION

The object of the present invention is to provide a fine tuning structure for headphones, to overcome the problem of bad comfortableness and possible leakage of sound.

An embodiment of the present invention provides a fine tuning structure for headphones, configured for tuning an angle between a head band and an audible unit of the headphone, is characterized in that the fine tuning structure comprises an upper assembly connected to an end of the head band and a lower assembly connected to the audible unit, the upper assembly and the lower assembly are hinged together, the upper assembly is provided with a limiting step, the lower assembly is movably connected to a limiting part, an end face of the limiting part is provided with a limiting curved surface abutted against the limiting step and configured for limiting an angle of the lower assembly relative to the upper assembly.

Furthermore, the limiting part includes a rotating shaft rotatable in an axial direction thereof and inserted in the lower assembly and a rotating plate provided at an end of the rotating shaft, an edge of an end face of the rotating plate surrounding the rotating shaft is provided with an annular band, the limiting curved surface is formed by an outer end faces of the annular band, thickness of the annular band is gradually increased in a clockwise direction or anti-clockwise direction.

Furthermore, the fine tuning structure further includes a connecting shaft configured for connecting the upper assembly and the lower assembly, an upper end of the lower assembly is provided with a connecting gap, the upper end of the lower assembly is provided with first corresponding axle holes close to two ends of the connecting gap, a lower end of the upper assembly is provided with a protruded block inserted in the connecting gap, a second axle hole is transversely defined in the protruded block, the limiting step is defined in the protruded block.

Furthermore, the protruded block is further provided with a rotating cavity configured for preventing the rotating plate from interfering with the protruded block when the rotating plate is rotated.

Furthermore, the protruded block is further provided with a rotating sliding chute configured for preventing the protruded block from interfering with the rotating plate, a lower end of the rotating sliding chute is connected to the rotating cavity.

Furthermore, the lower assembly further includes a knob configured for tuning a rotating angle of the limiting part, the rotating shaft is inserted and fixed in the knob.

Furthermore, an outer side face of the knob is provided with a plurality of grooves, an outer end face of the knob is provided with scales configured for identifying rotation angles.

Furthermore, the fine tuning structure further includes a soft rubber ring configured for increasing rotating resistance of the limiting part, the soft rubber ring is fixed in the lower assembly, the rotating shaft is passed through the soft rubber ring.

The fine tuning structure according to the present invention can select a different place on the limiting curved surface to abut against the limiting step, so that a limit angle between the upper assembly and the lower assembly can be limited so as to tune the angle between the head band and the audible unit. Thus, the wearing comfort of the headphone can be improved, and the leakage of sound is avoided.

According to the present invention, a headphone is provided and includes a head band and two audible units, and further includes the above-mentioned fine tuning structure.

Furthermore, the fine tuning structure is arranged between each audible unit and the head band.

The headphone according to the present invention includes the fine tuning structure which can fine tune the angle of the audible unit, so that the wearing comfort of the headphone can be improved, and the leakage of sound is avoided.

DETAILED DESCRIPTION OF THE INVENTION

Figure 1:
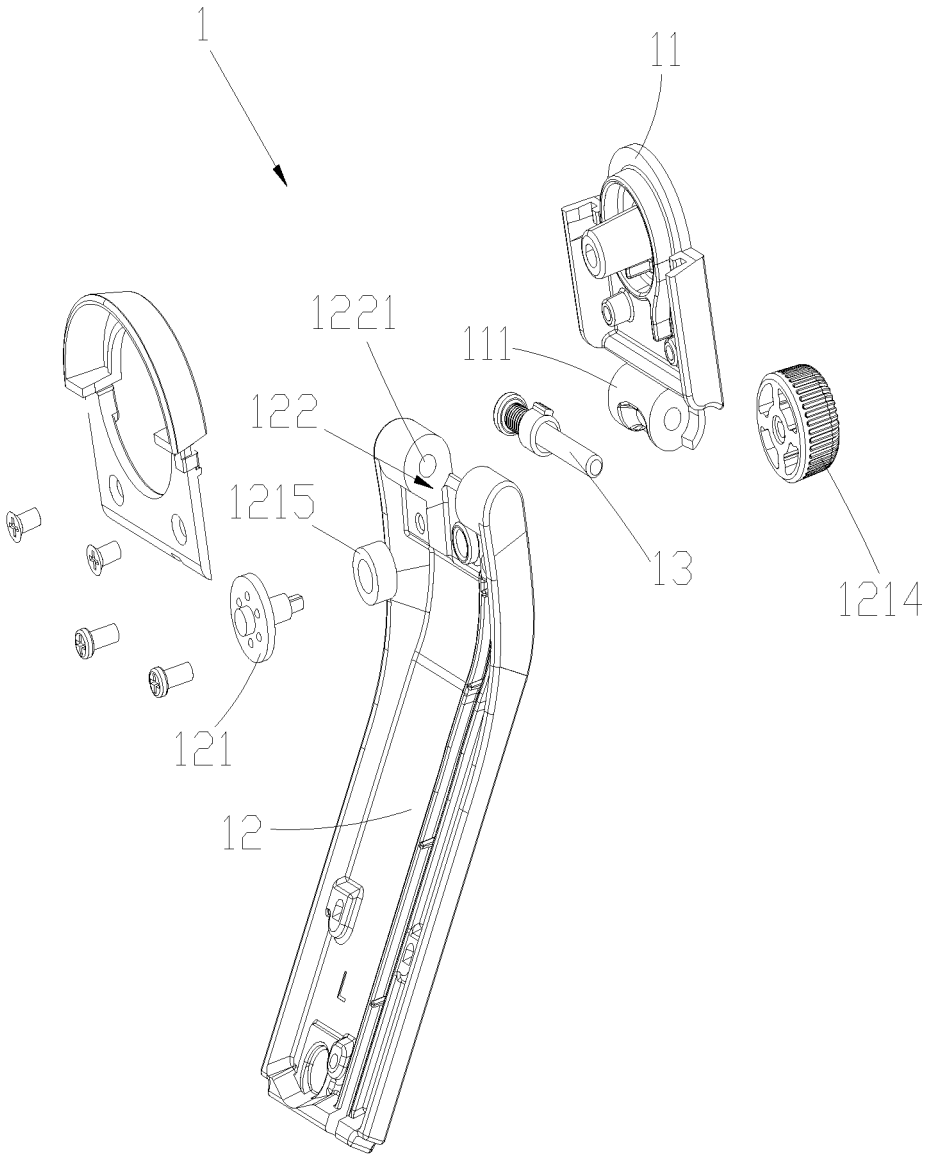
FIG. 1 is a schematic exploded structure view of a fine tuning structure for headphones according to an embodiment of the present invention.

In order to make clearer the objects, technical solutions and advantages of the invention, the present invention will be explained below in detail with reference to the accompanying drawings and embodiments. It is to be understood that the following description of the embodiments is merely to explain the present invention and is no way intended to limit the invention.

Implementations of embodiments of the present invention will be explained below in detail with reference to the accompanying drawings.

As shown in FIGS. 1 to 4, a fine tuning structure for headphones 1 is disposed and connected between a head band 2 and an audible unit 3, the fine tuning structure 1 includes an upper assembly 11 and a lower assembly 12 which are hinged together, the upper assembly 11 is connected to an end of the head band 2, the lower assembly 12 is connected to the audible unit 3. The upper assembly 11 is provided with a limiting step 112, and the lower assembly 12 is movably connected to a limiting part 121. An end face of the limiting part 121 is provided with a limiting curved surface 12111, when one largest limit angle between the lower assembly 12 and the upper assembly 11 is formed by rotating the lower assembly 12 and the upper assembly 11, the limiting curved surface 12111 can abut against the limiting step 112 to limit the largest limit angle.

When it is needed to fine tune the audible unit 3, the headphone can be worn on the head to make the head band 2 open to provide elastic force, so that the two audible units 3 can closely contact with two ears, the inward-directed elastic force of the head band 2 and reacting force from the head are simultaneously applied on the upper assembly 11 and the lower assembly 12, so that the upper assembly 11 and the lower assembly 12 are rotated to a position at which one largest limit angle is formed. Since different places on the limiting curved surface 12111 are different in height, the different largest limit angles can be formed when the different places of the limiting curved surface 12111 are abutted, so that the angle of the audible unit 3 can be changed after the headphone is worn, that is the audible unit 3 has been fine tuned.

The fine tuning structure 1 according to the embodiment can precisely tune the angle of the audible unit 3 based on different shapes of human heads, so that the audible unit 3 can contact with an ear closely, the comfort is improved. Furthermore, the enclosed space can be easily formed between the audible unit 3 and the ear to avoid the leakage of sound.

Figure 2:
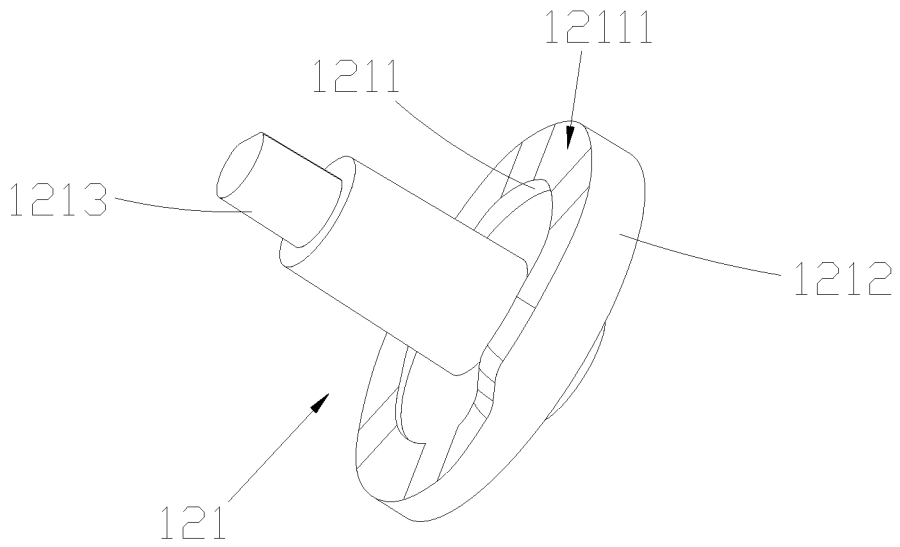
FIG. 2 is a schematic structure view of a limiting part of the fine tuning structure according to the embodiment of the present invention.

Other types of the limiting parts 121 can be used, such as, a sheet structure slidably arranged on the lower assembly 12, an outer side face of the sheet structure can be shaped as the limiting curved surface 12111. In the embodiment, as shown in FIGS. 1 and 2, the limiting part 121 is rotatable and includes a rotating shaft 1213 and a rotating plate 1212, the rotating plate 1212 is cylindrical in shape, the rotating shaft 1213 is disposed in the axis of the rotating plate 1212, an front end of the rotating shaft 1213 is inserted in the lower assembly 12 and can be rotated in the axial direction. An edge of an end face of the rotating plate 1212 surrounding the rotating shaft 1213 is provided with an annular band 1211, the limiting curved surface 12111 is formed by an outer end face of the annular band 1211, and the thickness of the annular band 1211 is gradually increased along a clockwise direction or an anti-clockwise direction. The rotating plate 1212 and the annular band 1211 can be molded in one body, as shown in the FIG. 2, it should be noted that the rotating plate 1212 and the annular band 1211 can also be independent assemblies. When the limiting part 121 is rotated, the thickness of the annular band 1211 at an abutted place on the limiting curved surface 12111 abutted against the limiting step 112 is gradually increased or reduced, meanwhile, the abutted place is changed. Thus, a required angle can be made via a linear tuning.

In the embodiment, the thickest section of the annular band 1211 is transited to the thinnest section of the annular band 1211 via an arc surface, so that if the limiting part 121 continues to be rotated after rotated to a limit section, the other limit section is arrived naturally. The limiting curved surface 12111 can also be provided with a plurality of grooves, in order to catch the limiting step 112 conveniently after the limiting part 121 is tuned.

As shown in FIG. 1, in order to operate easily, the lower assembly 12 further includes a knob 1214, the rotating shaft 1213 of the limiting part 121 is inserted and fixed in the knob 1214, the knob 1214 can be rotated to driving the limiting part 121 to rotate. An outer side face of the knob 1214 is provided with a plurality of grooves convenient for being clenched to rotate, an end face of the knob 1214 is provided with scales used for observing the scales corresponding to places on the limiting curved surface 12111. According to the scale, a rotation angle can be identified and the tuning level can be obtained, a thicker or thinner section of the annular band 1211 can be selected by the rotation of the knob.

A soft rubber ring 1215 is fixed in the lower assembly 12, the rotating shaft 1213 of the limiting part 121 passes through and closely contacts with the soft rubber ring 1215, the soft rubber ring 1215 can increase the rotating resistance of the limiting part 121, thereby providing a buffer at some extent and improving the rotation feel, thus too much rotation caused by too small rotating resistance can be avoided.

Figure 3:
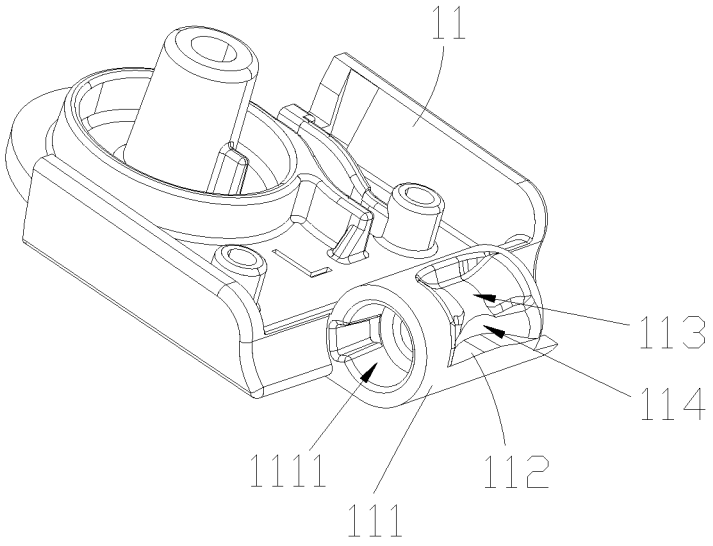
FIG. 3 is a schematic structure view of an upper assembly of the fine tuning structure according to the embodiment raise of the present invention.

There may be a plurality of hinging connections, such as, a combination of a protruded column and a concave cylindrical cavity, between the upper assembly 11 and the lower assembly 12. In the embodiment, a connecting shaft 13 is provided to hinge the upper assembly 11 and the lower assembly 12. As shown in FIGS. 1 and 3, an upper end of the lower assembly 12 is provided with a connecting gap 122, the upper end is provided with two first corresponding axle holes 1221 which are close to two ends of the connecting gap 122, an lower end of the upper assembly 11 is provided with a protruded block 111, a second axle hole 1111 is transversely defined in the protruded block 111, the connecting shaft 13 is arranged in the first axle holes 1221 and the second axle hole 1111. By using the connecting shaft 13 as an axis, the lower assembly 12 can rotate relative to the upper assembly 11, and the limiting step 113 is defined in the protruded block 111.

As shown in FIG. 3, in addition to the limiting step 112, the protruded block 111 is further provided with a rotating cavity 114, the rotating plate 1212 rotates in the rotating cavity 114 during the rotation of the limiting part 121 and doesn't interfere with the protruded block 111.

The protruded block 111 is also provided with a rotating sliding chute 113, a lower end of the rotating sliding chute 113 is connected to the rotating cavity 114, so that a cavity extending around the axis of the protruded block 111 can be formed. When the headphone isn't worn, the lower assembly 12 can be rotated in a larger angle scope, the rotating plate 1212 of the limiting part 121 can be slide in the rotating sliding chute 113 and will not interfere with the protruded block 111.

Figure 4:
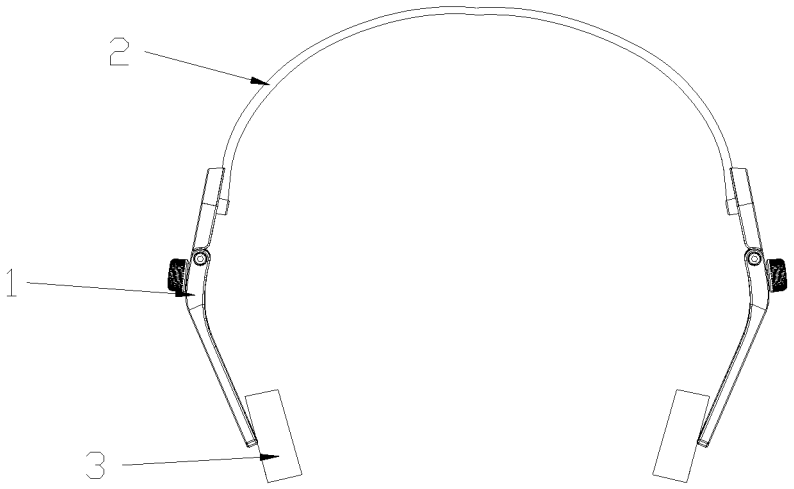
FIG. 4 is a schematic structure view of a headphone according to the embodiment of the present invention wherein the headphone includes the fine tuning structure.

As shown in FIG. 4, according to an embodiment of the present invention, a headphone is provided and includes a head band 2, the above-mentioned fine tuning structure 1 and two audible units 3. In the headphone of the embodiment, the angle of the audible unit relative to the head band 2 can be tuned by the fine tuning structure 1, the wearing effect can be finely improved, not only is the wearing comfort improved, but also the leakage of sound is avoided.

In actual design, it is possible that only one fine tuning structure 1 is arranged, then the angles of the audible units 3 at left and right sides can be balanced via elasticity of the head band 2, thus the fine tuning is completed, at the same time, the cost of the headphone can be saved. In the embodiment, there is the fine tuning structure 1 between each audible unit 3 and the head band 2. The two fine tuning structures 1 arranged at two sides of the headphone can be tuned synchronously or asynchronously, so that the wearing effect can be finely improved.

The above-mentioned is only the preferred embodiments of the present invention, but places no limit to the invention. Therefore, any modification, equivalent replacement and improvement etc on the basis of the spirit and principle of invention shall be within the protective scope of the present invention.

The invention claimed is:

1. A fine tuning structure for headphones, configured for tuning an angle between a head band and an audible unit of the headphone, is characterized in that the fine tuning structure comprises an upper assembly connected to an end of the head band and a lower assembly connected to the audible unit, the upper assembly and the lower assembly are hinged together, the upper assembly is provided with a limiting step, the lower assembly is movably connected to a limiting part, an end face of the limiting part is provided with a limiting curved surface abutted against the limiting step and configured for limiting an angle of the lower assembly relative to the upper assembly; an upper end of the lower assembly is provided with a connecting gap, the upper end of the lower assembly is provided with first corresponding axle holes close to two ends of the connecting gap, a lower end of the upper assembly is provided with a protruded block inserted in the connecting gap, a second axle hole is transversely defined in the protruded block, the limiting step is defined in the protruded block.

2. The fine tuning structure according to claim 1, is characterized in that the limiting part comprises a rotating shaft rotatable in an axial direction thereof and inserted in the lower assembly and a rotating plate provided at an end of the rotating shaft, an edge of an end face of the rotating plate surrounding the rotating shaft is provided with an annular band, the limiting curved surface is formed by an outer end face of the annular band, thickness of the annular band is gradually increased in a clockwise direction or anti-clockwise direction.

3. The fine tuning structure according to claim 2, is characterized in that the fine tuning structure further comprises a connecting shaft configured for connecting the upper assembly and the lower assembly.

4. The fine tuning structure according to claim 3, is characterized in that the protruded block is further provided with a rotating cavity configured for preventing the rotating plate from interfering with the protruded block when the rotating plate is rotated.

5. The fine tuning structure according to claim 4, is characterized in that the protruded block is further provided with a rotating sliding chute configured for preventing the protruded block from interfering with the rotating plate, a lower end of the rotating sliding chute is connect to the rotating cavity.

6. The fine tuning structure according to claim 5, is characterized in that the lower assembly further comprises a knob configured for tuning a rotating angle of the limiting part, the rotating shaft is inserted and fixed in the knob.

7. The fine tuning structure according to claim 6, is characterized in that an outer side face of the knob is provided with a plurality of grooves, an outer end face of the knob is provided with scales configured for identifying rotation angles.

8. The fine tuning structure according to claim 7, is characterized in that the fine tuning structure further comprises a soft rubber ring configured for increasing rotating resistance of the limiting part, the soft rubber ring is fixed in the lower assembly, the rotating shaft is passed through the soft rubber ring.

9. A headphone, is characterized in that the headphone comprises a head band and two audible units, and further comprises the fine tuning structure according to claim 1.

10. The headphone according to claim 9, is characterized in that the fine tuning structure is arranged between each audible unit and the head band.

* * * * *